United States Patent [19]

Jones

[11] Patent Number: 4,566,253

[45] Date of Patent: Jan. 28, 1986

[54] PACKAGING SYSTEM WITH INTERDIGITATING FILM ADVANCE

[75] Inventor: Robert W. Jones, Atlanta, Ga.

[73] Assignee: Kliklok Corporation, Greenwich, Conn.

[21] Appl. No.: 613,229

[22] Filed: May 23, 1984

[51] Int. Cl.[4] ..... B65B 9/10; B65B 41/12

[52] U.S. Cl. ..... 53/451; 53/551; 53/389; 226/88

[58] Field of Search ..... 53/551, 389, 552, 451, 53/452, 229; 226/88; 264/288.8

[56] References Cited

U.S. PATENT DOCUMENTS 3,364,293 1/1968 Culpin ..... 264/288.8

4,040,237 8/1977 O'Brien ..... 53/551

FOREIGN PATENT DOCUMENTS 1384450 2/1975 United Kingdom ..... 53/229

*Primary Examiner*—Horace M. Culver

*Attorney, Agent, or Firm*—King, Liles & Schickli

[57] ABSTRACT

A packaging apparatus for bulk material is disclosed having a former transforming packaging film into a tube, interdigitating means engaging and advancing the film over the former, delivery means for providing a charge of material or product to the package at the bottom of the tube and sealing and cutting jaws to complete the package. The interdigitating means for feeding the new length of material includes idler rollers mounted on support arms. The rollers engage the sides of the tube, flatten the tube and upon continued movement form an elongated zig-zag path to provide the next package length. Before feeding the film F, stripping action can be initiated by initial film feed movement. An upstream brake is engaged to hold the film during the stripping action and released during the film feeding action. Springs on the upper and lower rollers assure alignment of the film and prevent over stressing of the tube.

19 Claims, 12 Drawing Figures

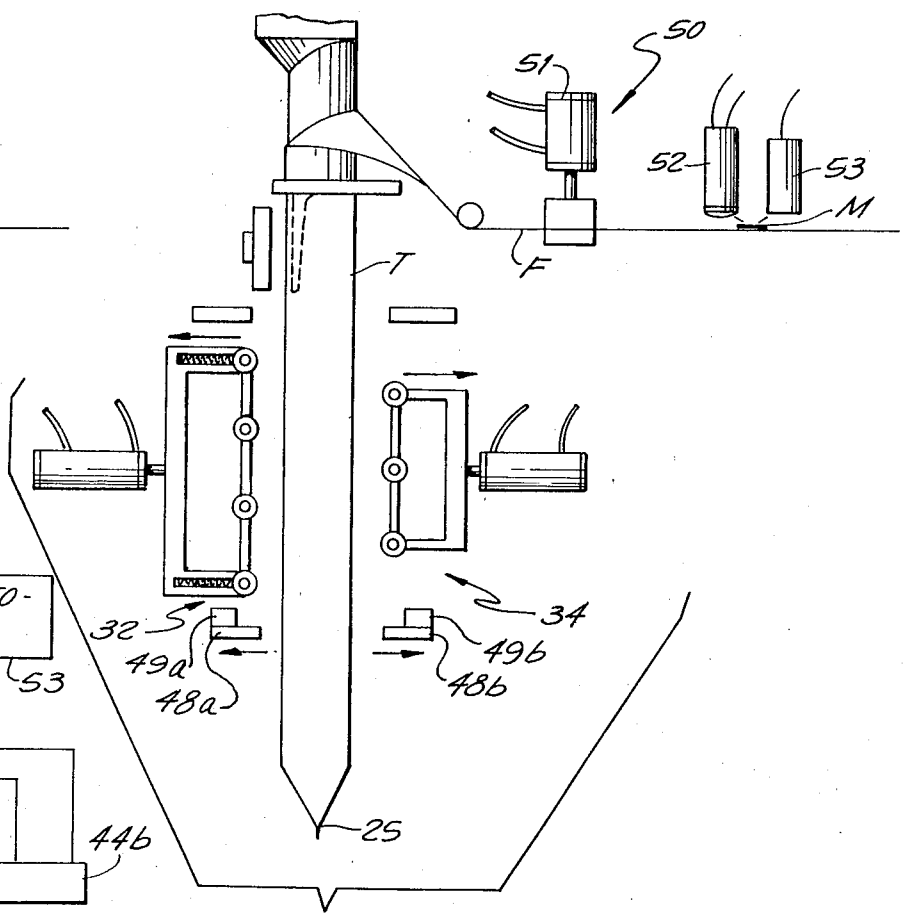
Fig. 10
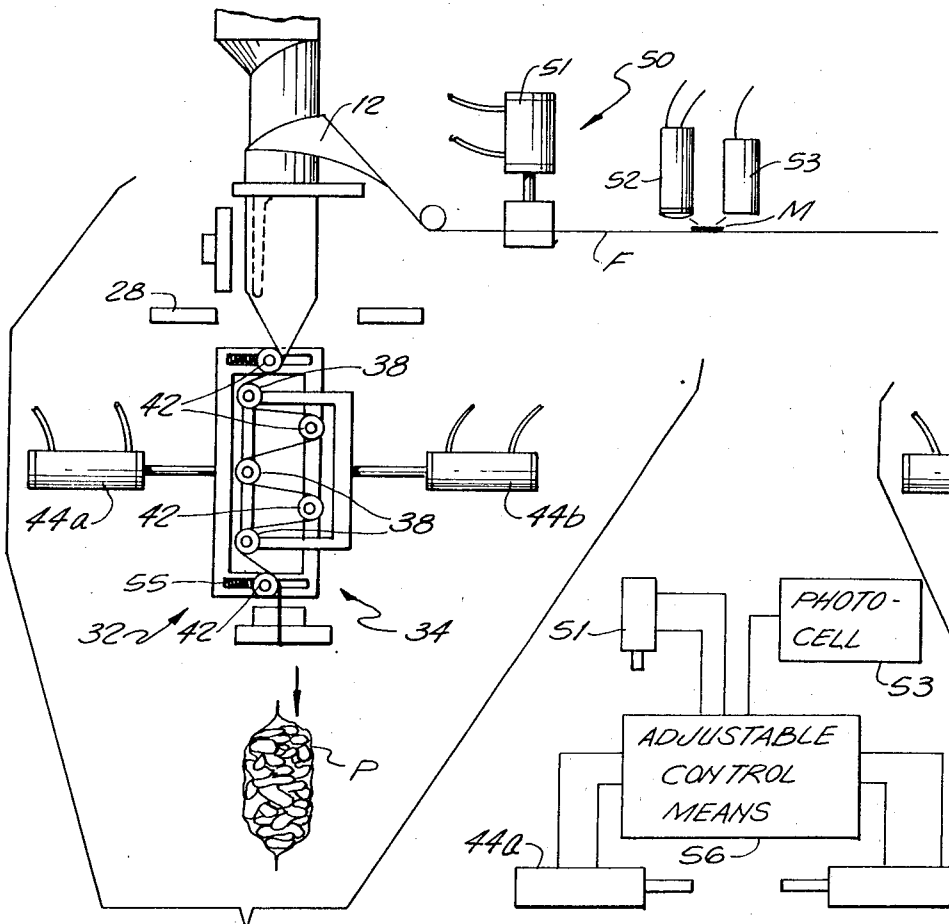
Fig. 11
Fig. 9

PACKAGING SYSTEM WITH INTERDIGITATING FILM ADVANCE

TECHNICAL FIELD

The present invention relates generally to the packaging field and, more particularly, to a method and apparatus for the forming of a tube from a continuous flexible material or film, delivering of bulk material into the bottom of the tube, and sealing and cutting of a filled package from such a tube in an automatic and continuous manner.

BACKGROUND ART

Machines for the forming, filling and sealing of packages made from a continuous web or film of material are well known in the art. Such machines require a smooth and efficient means for advancing the film over the former in cooperation with the other parts of the system to insure that the film is to be properly formed into a tube, filled and then sealed into individual packages.

In order to meet this requirement, film advancing mechanisms usually are built using clamps that engage and move the tube. Typically, the movement is imparted by moving the clamping/sealing jaws, or clamping/rotating feed belts or rollers in engagement with the tube above the sealing jaws. Many packaging machinery users prefer the belt/roller approach, and considerable research and development is proceeding in this direction today. As shown in relatively recent U.S. Pat. Nos. 3,918,235 to Brown, Jr. et al and 3,826,061 to Hunter, the rollers or belts for advancing the film are externally engageable with opposite sides of the film along a hollow mandrel that allows product delivery to the tube. Belts and rollers, however, are not without their disadvantages.

Over an extended period of use, belts may stretch and wear to the extent that they began to slip over the pulleys with which they are associated and driven and/or slip on the packaging film. This slipping deleteriously leads to an uneven film advancing action, or advancing film not of a sufficient length for forming a complete package within the allocated time. Similar problems also arise with the use of rollers where a relatively small surface area on the periphery of each rotating roller contacts the film at any one time to provide the advancing action. With reduced surface area, there is a greater probability of slipping against the film leading to uneven or insufficient film advance.

In an effort to overcome these problems complicated vacuum belt or roller systems have been provided as, for example, in U.S. Pat. No. 4,043,098 to Putman, Jr. et al. In such a system air is drawn through the belt or roller from the surface facing the film. The suction created aids in the clamping of the film so as to prevent slipping and provide consistent and proper film advance.

Despite the improved film advancing action that a vacuum roller belt system provides, there are still disadvantages. The vacuum equipment for drawing air through the belts or rollers greatly increases the initial capital expense of the package forming equipment. Further, additional and costly labor intensive maintenance of the vacuum system is periodically required and the down time associated with this maintenance has an adverse effect of productivity.

Recognizing the disadvantages of advancing a continuous film by the rotating action of endless belts or rollers, the prior art also includes the development of some complicated reciprocating drive means for forming a loop of film as, for example, shown in U.S. Pat. No. 3,762,128 to Persson et al. In Persson, rollers attached to reciprocating swing arms pull a loop of film from the supply reel. The loop of film is then pulled down and advanced over the former by the weight of material filled into the previously formed bag. This two-stage film advancing mechanism fails to provide the positive action necessary for the even, smooth and efficient advancing of film over the tube former. The likelihood of improper tube formation from the continuous film is greatly increased. This, of course, results in unreliable packaging machine performance.

Consequently, a need is identified for a packaging machine having a simple and reliable film advancing mechanism providing smooth and consistent operation without slipping and cooperating with the other components of the machine in a new, more efficient manner.

DISCLOSURE OF THE INVENTION

Accordingly, it is a primary object of the present invention to provide a method and apparatus for the forming, filling and sealing of packages made from a continuous sheet of material overcoming the above-described limitations and disadvantages of the prior art.

Another object of the present invention is to provide a packaging machine with a simple and reliable film advancing system and method providing improved and consistent film advancing action over the tube former and through the other portions of the machine.

A further object of the present invention is to provide a form, fill and seal packaging machine and method with an improved film advancing system and method that prevents slipping and uneven film advance, thereby insuring that the proper amount of film is pulled for forming a complete package on each cycle.

Still another object of the present invention is to provide such a packaging machine with a film advancing mechanism that reciprocates laterally across the formed tube with interdigitating action to advance a precise amount of packaging film.

It is still another object of the present invention to provide a machine and method for both stripping the product in the package formed and pulling a new package length for the next package by interdigitating action.

Still another object of the present invention is to provide a packaging machine and method utilizing an easily controllable film advancing system that is highly accurate and also allows rapid feeding of the product into the package during each cycle.

Additional objects, advantages and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus and method for packaging of bulk product or material is provided. While the preferred embodiment of the invention is described with respect to an edible product, such as potato chips, it will be realized that the principles of the invention can be applied to many types of bulk product.

The apparatus for packaging in accordance with the invention includes a former means to transform a continuous packaging film into a tube, interdigitating means positioned on opposite sides of the tube for engaging the tube and advancing the film over the former means, delivering means for providing a charge of bulk material to the package and sealing and cutting means for completing the package. As indicated, the interdigitating means upon engagement of the tube will first flatten the tube and then pull a new length of tube along an elongated zig-zag path.

In accordance with the preferred embodiment of the invention, the interdigitating means comprises rollers alternately spaced on opposite sides of the tube and upon actuation cross over the longitudinal axis of the tube thus forming the zig-zag path. A first series of rollers is supported on one side by a first support arm and a second series of rollers is supported on the opposite side by a second support arm. The two support arms are off-set so that the rollers are mounted in a cantilever fashion.

In accordance with another aspect of the present invention, at least the upper and lower rollers are resiliently biased so as not to pass beyond the centerline of the film in order to maintain alignment of the film with the former and sealing jaws, respectively. Also, when the film is stopped after a new length of film is pulled, a slight over travel of the interdigitating rollers does not overstress the film since the springs absorb the tension. The support arms are moved by suitable pneumatic cylinders and are controlled by an adjustable control so that different lengths of film may be run on the machine.

Preferably, the rollers are spaced on opposite sides of the vertically extending tube. Upon actuation, the rollers close against the tube and the interior rollers (except for the upper & lower rollers) cross over the longitudinal axis thereby forming a zig-zag path as the rollers move substantially horizontally. Upon retraction of the actuators, the rollers open to allow the tube to expand so that a charge of bulk material or product can be easily fed to the bottom of the tube and into the package by gravity.

In order to operate most efficiently, the interdigitating means are positioned between the former means and the cutting and sealing means that completes the package. As the interdigitating means, such as the rollers described above engage the tube, the tube can be moved either in the up direction, for stripping action below, or in the down direction for feeding of a new length of film. In order to feed the new length of film, the sealing jaws hold the tube firmly in position downstream and an upstream brake is released so that the film is properly drawn over the former. If desired, an agitating means may also be employed to settle the product just prior to activation of the interdigitating means.

In accordance with the basic method of the invention, the continuous packaging film is first formed into a tube, the product is delivered to the tube and the tube sealed to form a package. In accordance with an important aspect of the present invention, as the package is formed, the step of advancing the film to pull a new length of film is initiated. The film is advanced by engaging the sides of the tube with interdigitating means to form an elongated zig-zag path of the film. To complete the package, the step of cutting the film tube is performed and the next cycle of the packaging method is initiated.

Preferably, the advancing step is performed by laterally moving the interdigitating means across the film. Also included in the method is the concept of actually crossing the interdigitating means along the longitudinal axis of the tube to form the zig-zag path. The additional step of agitating the film tube is performed during the method prior to engaging the tube with the interdigitating means. In order to terminate the advancing motion of the film, there is included a step of stopping the interdigitating action and simultaneously braking the film. Also, in another aspect of the invention, stripping of the product in the package is performed by the interdigitating means prior to advancing the film. Also in accordance with the preferred procedure, the film is clamped at the sealing location during sealing to allow the interdigitating means to pull a new length of film. Advantageously, the crossing of the interdigitating means along the longitudinal axis of the tube insures that an even pulling pressure is exerted across the film. The film is pulled at a desired rapid, but controlled speed that is the combination of the speed of movement of the interdigitating rollers. Once the sensing means, preferably a photocell, indicates the full length is pulled, the interdigitating action is terminated and the brake is reengaged, the sealing jaws open and the tube is allowed to drop into an extended position in readiness for the delivery of the next charge of bulk material.

Still other objects of the present invention will become readily apparent to those skilled in this art from the following detailed description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and the description will be regarded as illustrative in nature and not as restrictive.

BRIEF DESCRIPTION OF THE DRAWINGS

The accompanying drawings incorporated in and forming a part of the specification, illustrates several aspects of the present invention, and together with the description serves to explain the apparatus, the operating method and all of the principles of the invention. More specifically, in the drawings:

FIG. 9 is a schematic representation showing the new length of film having been pulled, the film brake actuated into position and the completed package cut from the tube;

FIG. 10 is the final schematic representation showing the interdigitating rollers retracting to the open position and the formed tube dropping into position, as shown in FIG. 1; and FIG. 11 is a schematic diagram showing the control circuit for the interdigitating roller means of the present invention.

BEST MODE FOR CARRYING OUT THE INVENTION

Figures 1, 2, 3, 3A:
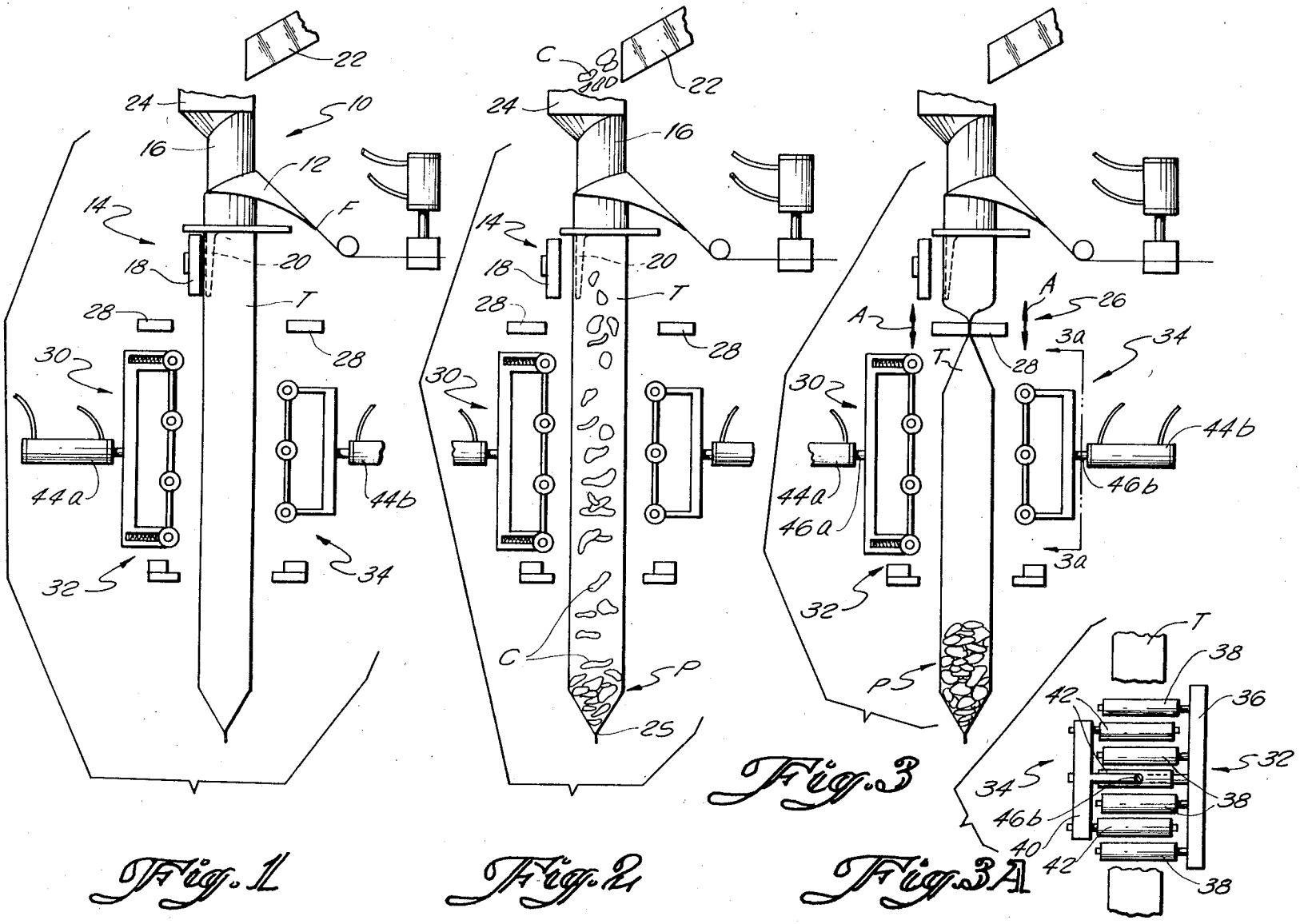
FIG. 1 is a schematic representation of a form, fill and seal packaging apparatus utilizing the apparatus and method concepts of the present invention and showing the new length of the tube after being pulled and dropped into position for filling and forming a new package.
FIG. 2 is a schematic representation of the packaging apparatus and method of the present invention and illustrating the delivery of a charge of bulk material into the new package.
FIG. 3 is a subsequent schematic representation showing the step of agitating the film tube to settle the previously delivered bulk material into the package.
FIG. 3*a* is a cross-sectional view taken along lines 3*a*—3*a* of FIG. 3 with the tube broken away for clarity showing the cantilever mounting of the interdigitating rollers.

Reference is now made to FIG. 1 of the drawings illustrating in schematic form a packaging apparatus 10 of the form, fill and seal type. Packaging film F is fed from a supply roll (not shown) and is moved over a former 12 to form a continuous tube T. As the film F advances over the former 12, it is formed into the tube around a hollow mandrel 16. The longitudinal margins or edges of the film come together in overlapping relation in the area of the former 12.

A seam sealing means 14 includes a heated sealing shoe 18 and a backup plate 20 forming a part of the mandrel 16. The sealing means operates in the manner well known in the art to provide a uniform longitudinal seal forming one side of the package.

As may be appreciated by viewing the drawings, especially FIG. 2, the packaging apparatus 10 also includes a feed chute 22 for delivering bulk material or product, such as potato chips C, into the funnel shaped top of the mandrel 16. A measured quantity of chips C are released from a scale (not shown) and travel by gravity down the mandrel 16 into the open ended tube. The chips fall be gravity into the bottom of the tube where a package P is being formed just above the transverse seal 25.

FIG. 3 illustrates an agitating mechanism 26 for gripping the tube T and agitating the same following delivery of the chips to the package P in the bottom of the tube. The agitating mechanism 26 includes a pair of clamping jaws 28, which normally occupy the open position (see FIGS. 1 and 2) and clamp the tube T when moved together (FIG. 3). Once the tube T is clamped, the jaws are moved substantially up and down, as shown by the action arrows A. This agitation or vibrating movement tends to settle the chips in the package P. The jaws are vibrated rapidly for a short time which allows the chips C to better settle by eliminating any bridging of the chips within the package P.

In these Figures, can also be seen the interdigitating assembly of the present invention, generally designated by the reference numeral 30. The interdigitating assembly is normally in the open position spaced away from the sides of the tube T.

Figure 4:
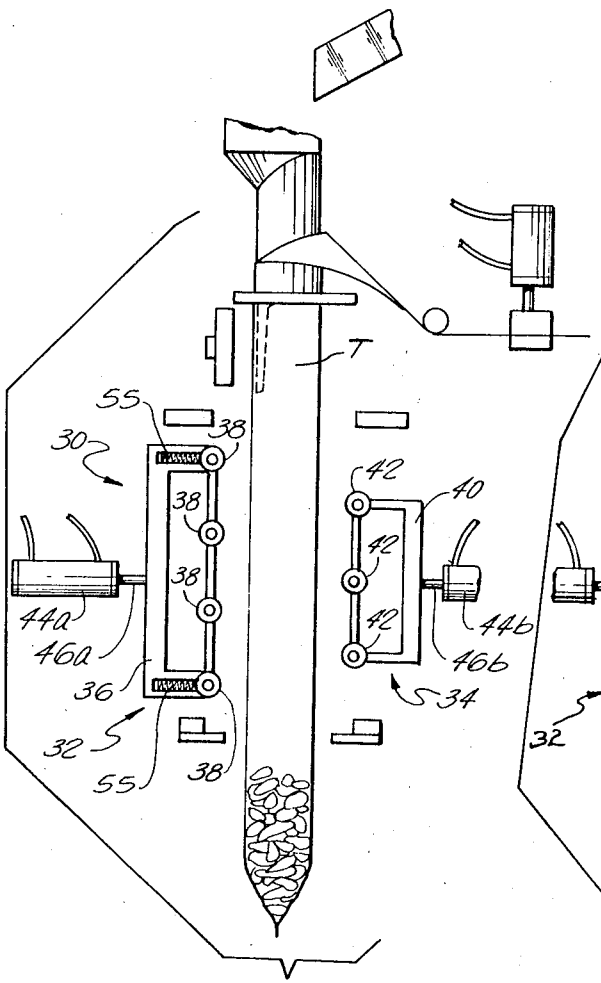
FIG. 4 is the next schematic representation illustrating the positioning after the release of the agitating jaws.

In the preferred embodiment, the interdigitating assembly 30 comprises first and second laterally movable roller means, generally designated by the reference numerals 32, 34 respectively (see FIGS. 3, 3*a* and 4). As will be seen in more detail later, the interacting roller means 32, 34 move the tube T, both up during the stripping action and downward during the feed of additional length of film.

The first roller means 32 comprises an offset support arm 36 with a plurality of idler rollers 38 mounted in a cantilever fashion. Similarly, roller means 34 includes an offset support arm 40 carrying a plurality of cantilever mounted rollers 42. As may be appreciated from viewing FIGS. 3, 3*a* and 4, the rollers are spaced or offset in the direction of the longitudinal axis of the tube T (tube broken away in FIG. 3*a* to show detail of rollers 38, 42). The offset nature of the rollers 38, 42 allows the rollers to interdigitate as the roller means 32, 34 are moved from the open position toward the closed position, as will be described more in detail later.

The roller means 32, 34 including the respective offset support arms 36, 40 are supported and moved toward and away from the tube T by two opposed power cylinders, such as pneumatic cylinders **44*a*, 44*b*. These cylinders include piston rods 46*a*, 46*b*, respectively, attached to the respective support arms 36, 40**.

Figure 6:
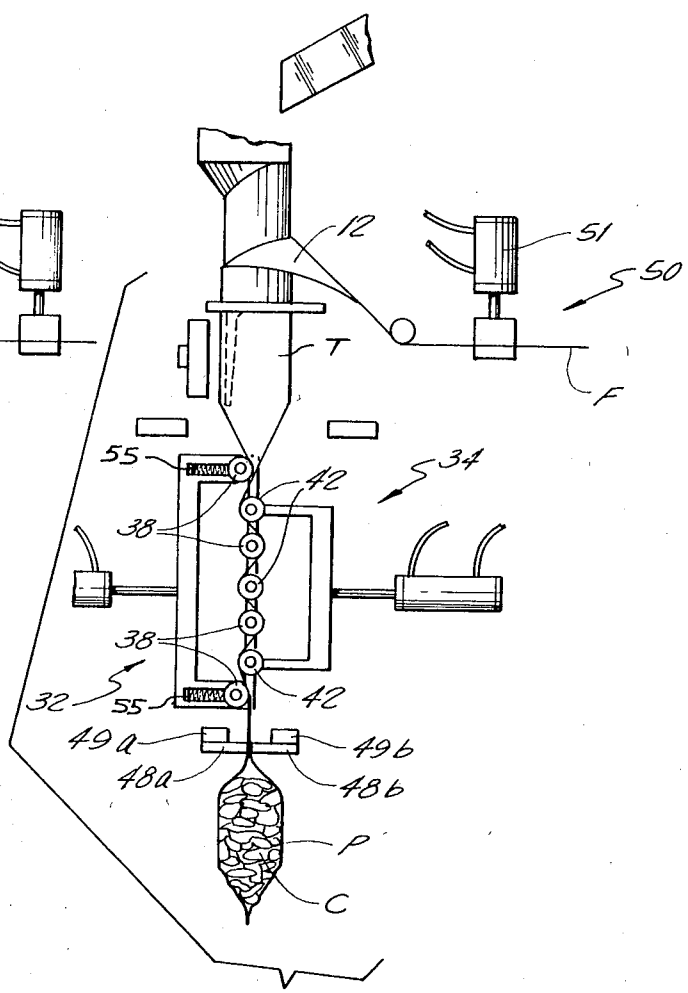
FIG. 6 is a similar schematic representation showing the interdigitating rollers engaging the tube and moving to an overlapped position forming a zig-zag path and raising the package for stripping action.
Figure 5:
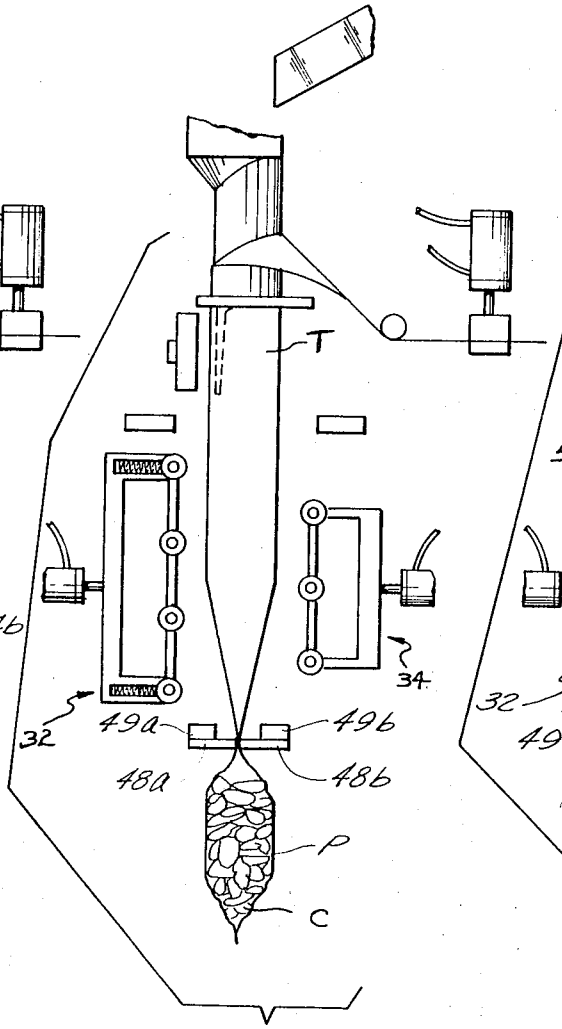
FIG. 5 is the next step showing the stripping jaws engaged with the tube above the newly formed package.

Viewing now FIGS. 5 and 6, the next operation in the preferred embodiment is disclosed. In FIG. 5, stripper jaws **48*a*, 48*b* are brought against the sides of the tube T so as to initially flatten the package P above the chips C in the package P. The strippers are operated in a conventional fashion from supporting actuators (not shown). The edges engaging the tube T are smooth and are thus adapted to slide along the tube when the package P is moved upwardly, (see for example FIG. 6). The stripping action for the package P is performed by pulling the tube up against the stripping jaws 48*a*, 48*b* (FIG. 6). This upward pulling motion is a result of the roller means 32, 34 flattening the tube T and moving inwardly to an overlapped position. The interdigitating action provides the upward movement sufficient to strip the product, as shown. The rollers 38, 42** are designed to be substantially aligned along the longitudinal axis of the tube T upon completion of the stripping action as shown in FIG. 6.

A packaging film brake 50 is positioned upstream of the former 12 and is designed to be actuated by a cylinder 51 in order to normally clamp the film F. As will be noted in FIGS. 5 and 6, the brake 50 is actuated so that the film F is firmly held in position during the stripping operation, just described.

Figure 7:
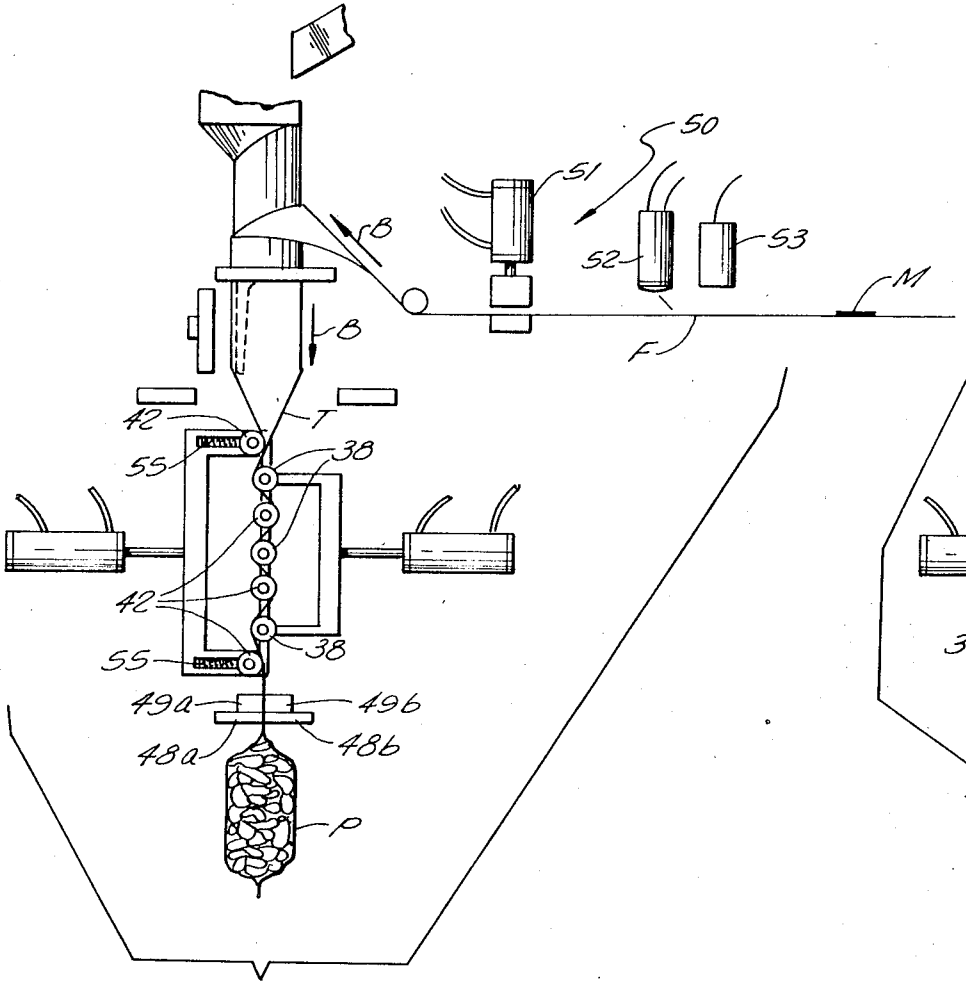
FIG. 7 is the next step shown in a schematic representation with the sealing jaws closed and the upper seal of the package being formed.

Once the stripping action is completed the sealing jaws **49*a*, 49*b* move together against the tube T just above the stripping jaws 48. A transverse seal is formed at this point to thus effectively seal the package P. At the moment the sealing jaws 49*a*, 49*b* close thus holding the tube T from below, the cylinder 51 of the brake 50 is actuated to release the brake and allow the film F to start to feed forward (in the direction of action arrow B; FIG. 7). As the interior rollers 38, 42 (not including the upper and lower rollers 42**) move from the position of alignment where the stripping is completed, the overlapping increases and they cross over the center line. As the zig-zag path is lengthened, the feed continues (FIG. 8) in the direction of arrow B. This provides for the feed of the next length of packaging film for the next package.

As indicated above, the interior rollers 38, 42 actually cross and move over the longitudinal axis of the tube T. This crossing motion and zig-zag path formation of the tube T provides for smooth feeding action with even pulling pressure of the film F across the former 12. This action insures the efficient advancing of the film and the formation of the tube T without the undesirable slippage that has been prevalent in the past. Since the rollers 38, 42 act in opposite directions against the sides of the tube T and do not depend on friction for pulling action, undesirable slippage as has been prevalent in the prior art is avoided.

As can be seen in FIGS. 7–10, an index mark M is included on the film F. A light source 52 is directed toward the film F with a photocell 53 positioned adjacent thereto. The mark M is brought into position as the feed of the film F continues until the direct 'reflection of the light from the source 52 activates the photocell 53 (see FIG. 9). At this point, the feeding of one package length is completed, the interditigating action is terminated and the brake 50 is actuated to stop the movement of the film F.

As best shown in FIGS. 7–10, the upper & lower rollers 42, not the interior rollers, can be resiliently mounted. As shown in the preferred embodiment, the upper and lower roller 42 of the roller means 32 are resiliently mounted by suitable springs 55. As shown, the springs are mounted to continuously bias the upper and lower rollers 42 toward the engagement with the tube T. During the initial engagement, as shown in FIG. 6 and carried over to FIG. 7, the system is designed for minimum compression of the springs 55. The stripping action can occur without imparting sufficient force to compress the springs 55 in any appreciable degree. However, at any time, the springs can compress as the interior rollers 38, 42 are moved to the cross over position, thereby maintaining alignment of the film with the former & sealing jaws and absorbing any momentary stress in the film F. Also, when the interdigitating action is stopped and the brake 50 is reactivated to stop the film once the mark M aligns so as to activate the photocell 53 (see FIG. 9), any slight over travel of the cooperating rollers 38, 42 of roller means 32, 34 will be absorbed. The end rollers 42 can simply continue to move a short distance compressing the springs 55 and thus alleviate any tendency for misalignment and over stressing of the film F.

In order to accurately stop the feeding action of the roller means 32, 34, the photocell 53 is preferably connected to an adjustable control means 56 operative to control the pneumatic cylinders 44*a*, 44*b* as shown in FIG. 11. The control means 56 is designed to fine tune the stopping point of the roller means 32, 34, as may be necessary with different length of packages and the use of different types of film F. The adjustable control means 56 may also be used to fine tune the actuation of the brake cylinder 51.

With the feed of the packaging film F completed, the stripper jaws 48*a*, 48*b* and the sealing jaws 49*a*, 49*b* are withdrawn along with the roller means 32, 34 (see FIG. 10). This allows the tube T to drop downwardly to the full extended position in readiness for the next packaging cycle beginning with FIG. 1 of the drawings.

As may be appreciated now, the movement of the interdigitating roller means 32, 34 is in a substantially horizontal plane, that is moving laterally into and away from the tube T. This allows the gravity delivery of the chips C after the tube has extended to the full length position with the roller means 32, 34 withdrawn to the open position. This desired feeding action of the chips is shown in FIG. 2. The pulling action of the roller means 32, 34 is also desirable in that it allows more positive advancing action since the force can be applied from downstream of the former 12.

The method of operation of the apparatus 10 is desirably simple and can be described and understood by viewing the figures substantially in sequence from FIG. 1 through FIG. 10. With a full length of material pulled into position (FIG. 1) the chips C are fed into the bottom of the tube for the next package P (FIG. 2). When the feeding action is completed, the agitating mechanism 26 is activated to settle the chips into the package P.

In FIGS. 5 and 6, the stripping jaws 48*a*, 48*b* engage the tube T and immediately thereafter the roller means 32, 34 are activated to flatten the tube T and move to an overlapping position. In this position, shown in FIG. 6, the rollers 38, 42 are substantially aligned and form a zig-zag path. Since the brake 50 is activated, the tube T will be drawn upwardly moving between the stripping jaws 48*a*, 48*b*. The chips C in the package P are further compacted and any chips in the seal area are removed.

Figure 8:
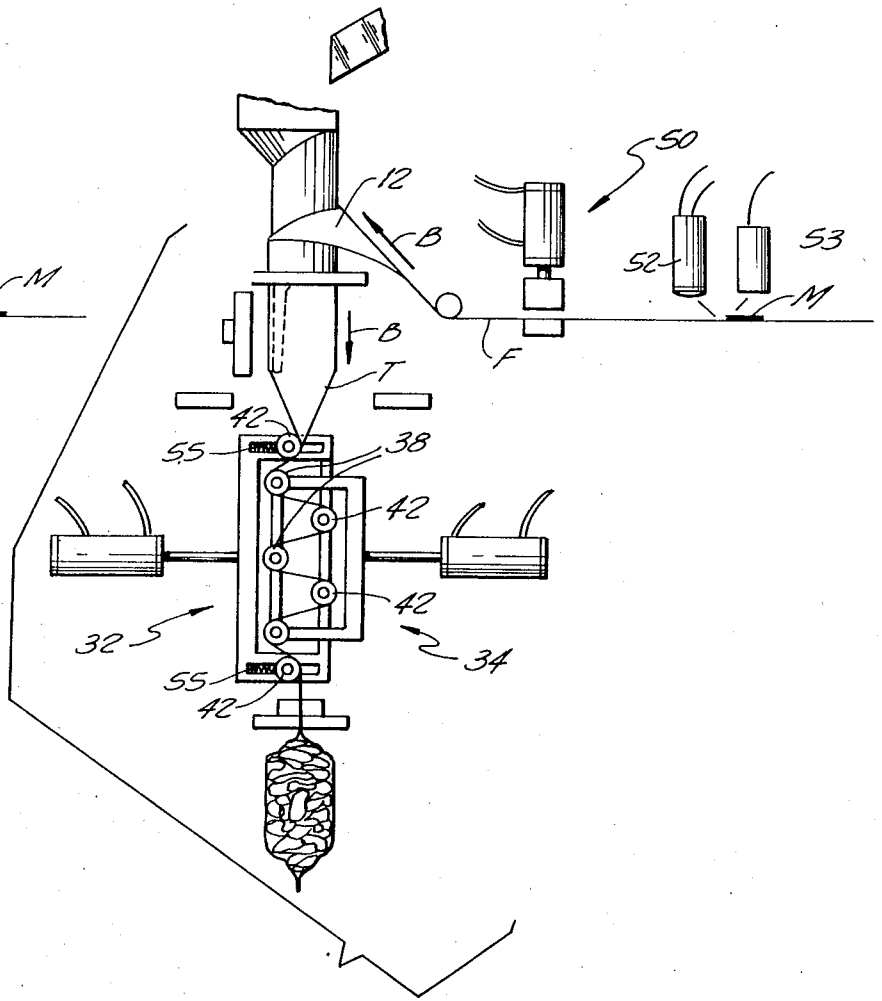
FIG. 8 is a schematic representation illustrating the interdigitating rollers pulling a new length of film while the sealing jaws hold the tube from below.

The sealing jaws 49*a*, 49*b* are now activated and the brake 50 is released (see FIG. 7). The continued movement of the interior rollers 38, 42 feed the film F forward, in the direction of arrows B. As the feeding continues, the springs 55 may be compressed so as to assure proper alignment and tensioning of the film (FIG. 8).

The final movement of the registration mark M into the range of the photocell 53 terminates the movement of the cylinders 44*a*, 44*b* and the brake applied (see control circuit in FIG. 11) thus stopping the movement of the film. A new package length is now stored in the zig-zag path between the rollers and the completed package P is cut and released (FIG. 9). Immediately thereafter, the sealing jaws 49*a*, 49*b* are withdrawn as are the roller means 32, 34 allowing the tube T to drop into position for the next cycle starting with FIG. 1.

In summary, numerous benefits and advantages are gained resulting from employing the apparatus and method concepts of the present invention. The interdigitating means provides an uncomplicated and reliable system for advancing the film over the former shoulder 12. It is the lateral crossing motion of the rollers 38, 42 that advances the film. The interdigitating means 30 operates downstream of the former 12 on the tube T with each new package length being formed along a zig-zag path. The rollers 38, 42 do not depend on friction for moving the tube T so that there is no problem with slippage. The problem associated with rotating rollers or belts loosing a grip on the film and slipping so as to unevenly or insufficiently advance the film is thus totally avoided. Compression springs 55 may be provided on the upper and lower rollers 42 in order to maintain alignment and protect against over stressing of the film F.

The feeding function is rapid, since feeding is a combination of movement of the several rollers 38, 42 crossing each other and forming the elongated zig-zag path.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. For example in another preferred embodiment, the springs 55 may be eliminated, and the interior rollers 42 simply carried on a separate support arm and cylinder. In this case, only the two cylinders for the rollers 38 and the interior rollers 42 are actuated during the film advancing step (FIGS. 8, 9). All such modifications and variations are within the scope of the invention as determined by the appended claims when interpreted in accordance with the breadth to which they are fairly, legally and equitably entitled.

I claim:

1. An apparatus for the packaging of bulk material, comprising:

means for forming a continuous film into a tube;

means for delivering a charge of the bulk material to a package being formed from said tube;

means for sealing and cutting said tube containing the bulk material into the package; and interdigitating means, positioned between said forming means and said cutting and sealing means, for engaging opposite sides of said tube and forming an elongated zig-zag path for advancing said film over said forming means.

2. The apparatus disclosed in claim 1, wherein said interdigitating means comprises roller means laterally movable with respect to the longitudinal axis of said tube.

3. The apparatus disclosed in claim 2, wherein said roller means comprise a first offset support arm supporting a first series of rollers and a second offset support arm supporting a second series of rollers, said rollers extending from the respective arm in a cantilever fashion.

4. The apparatus disclosed in claim 3, wherein at least one of said first series of rollers is resiliently biased to provide proper tensioning during film advance and proper alignment.

5. The apparatus disclosed in claim 3, wherein said interdigitating means further comprises actuator means for relatively moving said support arms from an open position on opposite sides of said film to a closed film feed position with interdigitating lateral roller position for advancing said film.

6. The apparatus disclosed in claim 5, wherein said first and second series of interdigitating rollers close and cross over the longitudinal axis of said tube during film feed movement thereby forming a zig-zag path.

7. The apparatus disclosed in claim 5, wherein said lateral movement is in a substantially horizontal plane, thereby allowing gravity delivery of bulk material to the bottom of said tube and into the package between said first and second series of rollers when in the open position.

8. The apparatus disclosed in claim 1, wherein means are provided for adjusting the range of lateral crossing movement of said first and second series of rollers, thereby providing film advance of a predetermined, adjustable length.

9. The apparatus disclosed in claim 1, further comprising brake means upstream of said forming means for maintaining the proper amount of film feed to the forming means.

10. The apparatus disclosed in claim 1, further comprising means for agitating said film tube upstream of said interdigitating means so as to settle the bulk material following delivery.

11. The apparatus disclosed in claim 9, further comprising stripper means downstream of said sealing and cutting means and operative during initial interdigitating action while said brake is activated to strip the product from the seal area.

12. A method for the packaging of bulk materials, comprising the steps of:

forming a continuous film into a tube;

delivering a measured quantity of bulk material into said tube;

sealing said tube to form a package;

advancing said film by engaging the sides of the tube with interdigitating means downstream from the forming step and upstream from the sealing step to form an elongated zig-zag path; and cutting said film tube containing the bulk material to complete the package.

13. The method disclosed in claim 12, wherein said tube is clamped downstream of said interdigitating means to allow film feed during the advancing step.

14. The method disclosed in claim 12, wherein said advancing step includes the step of laterally moving said interdigitating means across said film forming a zig-zag film path.

15. The method disclosed in claim 14, wherein said laterally moving step includes the step of crossing said interdigitating means substantially along the longitudinal axis of said tube to form said zig-zag path, thereby advancing said film a predetermined length.

16. The method disclosed in claim 12, further comprising the additional step of agitating said film tube following the delivery step, thereby settling the bulk material.

17. The method disclosed in claim 12, further comprising the additional step of braking said film while terminating the advancing step when a full package length has been advanced.

18. The method disclosed in claim 12, further comprising the additional step of stripping the material in said package by the initial engagement of the tube by said interdigitating means.

19. The method disclosed in claim 18, further comprising the additional step of clamping said film at the sealing location during sealing to allow a new length of film to be pulled.

* * * * *